United States Patent [19]

Iwai

[11] Patent Number: 4,821,687

[45] Date of Patent: Apr. 18, 1989

[54] TWO-STROKE ENGINE

[75] Inventor: Tomio Iwai, Hamamatsu, Japan

[73] Assignee: Sanshin Kogyo Kabushiki Kaisha, Hamamatsu, Japan

[21] Appl. No.: 80,951

[22] Filed: Jul. 31, 1987

[30] Foreign Application Priority Data

Aug. 1, 1986 [JP] Japan ..... 61-180015

[51] Int. Cl.[4] ..... F02B 33/04

[52] U.S. Cl. ..... 123/65 P; 123/73 PP; 123/65 W

[58] Field of Search ..... 123/65 PD, 65 WA, 65 P, 123/73 PP, 73 A, 65 VC, 65 W, 193 C

[56] References Cited

U.S. PATENT DOCUMENTS

| | | | |
|---|---|---|---|
| 3,542,000 | 11/1970 | Ellingsen | 123/73 B |
| 3,680,305 | 8/1972 | Miller | 123/65 VA |
| 4,146,004 | 3/1979 | Dubois | 123/257 |
| 4,248,185 | 2/1981 | Jaulmes | 123/73 PP |
| 4,549,508 | 10/1985 | Fujimoto | 123/73 PP |
| 4,671,219 | 6/1987 | Ooyama et al. | 123/65 P |
| 4,719,880 | 1/1988 | Schlunke et al. | 123/657 |

FOREIGN PATENT DOCUMENTS

| | | | |
|---|---|---|---|
| 513297 | 8/1952 | France | 123/73 A |
| 0143120 | 8/1983 | Japan | 123/73 A |
| 349423 | 5/1931 | United Kingdom | 123/65 P |
| 2142085 | 1/1985 | United Kingdom | 123/73 A |

*Primary Examiner*—David A. Okonsky

*Attorney, Agent, or Firm*—Ernest A. Beutler

[57] ABSTRACT

A combustion chamber and scavenging configuration for a two-cycle internal combustion engine. The combustion chamber is comprised of an offset recess surrounded by a squish area. An exhaust port is formed on the side of the cylinder opposite to the area where the recess is offset while the intake or transfer ports are disposed on the side to which the recess is offset. The transfer or scavenge ports are configured so as to open progressively first diametrically opposite to the exhaust port and then in an area extending around the area toward the exhaust port.

12 Claims, 2 Drawing Sheets

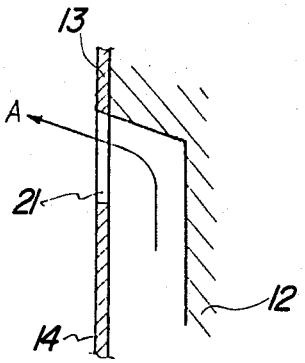
Fig-2
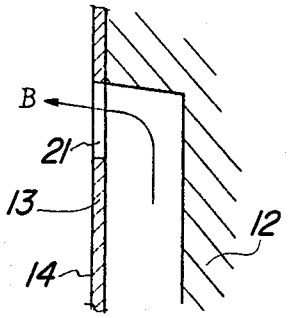
Fig-3
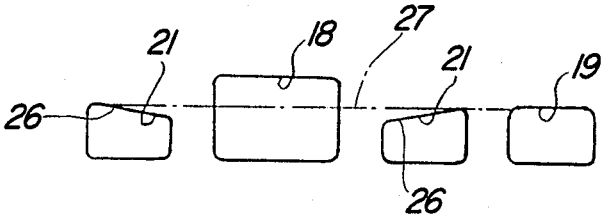
Fig-4
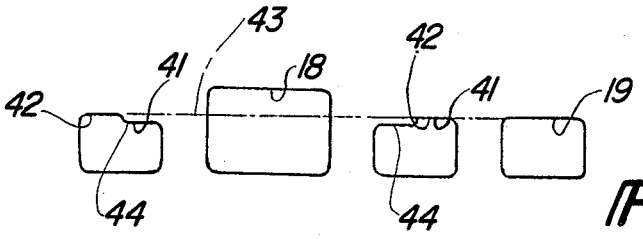
Fig-5
Fig-6
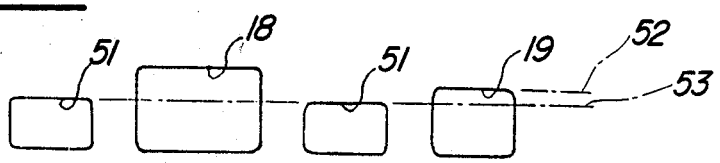

TWO-STROKE ENGINE

BACKGROUND OF THE INVENTION

This invention relates to a two-stroke engine and more particularly to an improved combustion chamber and porting configuration for such an engine.

The advantages of two-stroke crankcase compression internal combustion engines are well known. Such engines have particular utility because of their extremely simple design and also because of their relatively high specific output for the size of the displacement of the engine. However, the very features which make two-cycle engines desirable also give rise to certain deficiencies. That is, because of the two-stroke cycle of operation, the fresh intake charge is being drawn into the combustion chamber at the same time the previously burnt charge is being exhausted from it. Therefore, there is a danger that either the chamber will not be fully purged of the previous combustion products, or alternatively, a portion of the incoming fresh fuel/air mixture will pass out of the exhaust port and be lost without ever having been burned. In addition, it is important that the combustion chamber configuration and spark plug location be chosen so that the entire charge within the combustion chamber is burned before it is exhausted from the exhaust port.

In the co-pending application entitled "Combustion Chamber For Spark-Ignited Engine", Ser. No. 936,337, filed Dec. 1, 1986 in the name of Kimihiro Nonaka and assigned to the assignee of this application, there is disclosed a combustion chamber configuration for a two-cycle engine that is particularly efficient in insuring that the entire charge in the chamber is burned. That patent application also shows an engine embodying a type of scavenging which is found to be particularly effective and which is called the loop or Schnule scavenging. With this type of scavenging, the exhaust port or intake ports are on opposite sides of the combustion chamber and the flow through the combustion chamber follows a loop pattern looking at the chamber in vertical cross section. However, it has been found that the type of scavenging system employed in that engine can be improved so as to insure that none of the fresh air/fuel mixture will flow out of the exhaust port while at the same time insuring that all of the burned fuel/air mixture from the previous cycle has been exhausted.

It is, therefore, a principal object of this invention to provide an improved combustion chamber and porting arrangement for a two-cycle engine.

It is a further object of this invention to provide an improved combustion chamber and loop scavenging system for a two-cycle, internal combustion engine.

SUMMARY OF THE INVENTION

This invention is adapted to be embodied in a combustion chamber for a two-cycle crankcase compression internal combustion engine having a cylinder, a piston reciprocating in the cylinder and a cylinder head which closes the cylinder and defines with the piston and cylinder a combustion chamber. The combustion chamber is comprises of the large recessed area at one side of the cylinder and a surrounding squish area when the piston is at top dead center. Exhaust port means open into the cylinder at a side thereof which is opposite to the one side to which the combustion chamber large recessed area is offset. Transfer port means are disposed on that one side of the cylinder for admitting a charge thereto.

In accordance with this feature of the invention, the transfer port means are configured relative to the piston to introduce the charge initially at the area directly on the one side and subsequently around the cylinder toward the opposite side upon continuing opening of the transfer port means by the piston movement.

BRIEF DESCRIPTION OF THE DRAWINGS

FIG. 2 is a cross-sectional view taken along the line 2—2 of FIG. 1.

FIG. 3 is a cross-sectional view taken along the line 3—3 of FIG. 1.

FIG. 4 is a developed view showing the port configuration.

FIG. 5 is a developed view, in part similar to FIG. 4, showing another embodiment of the invention.

FIG. 6 is a developed view, in part similar to FIGS. 4 and 5, showing another embodiment of the invention.

DETAILED DESCRIPTION OF THE PREFERRED EMBODIMENT OF THE INVENTION

Figure 1:
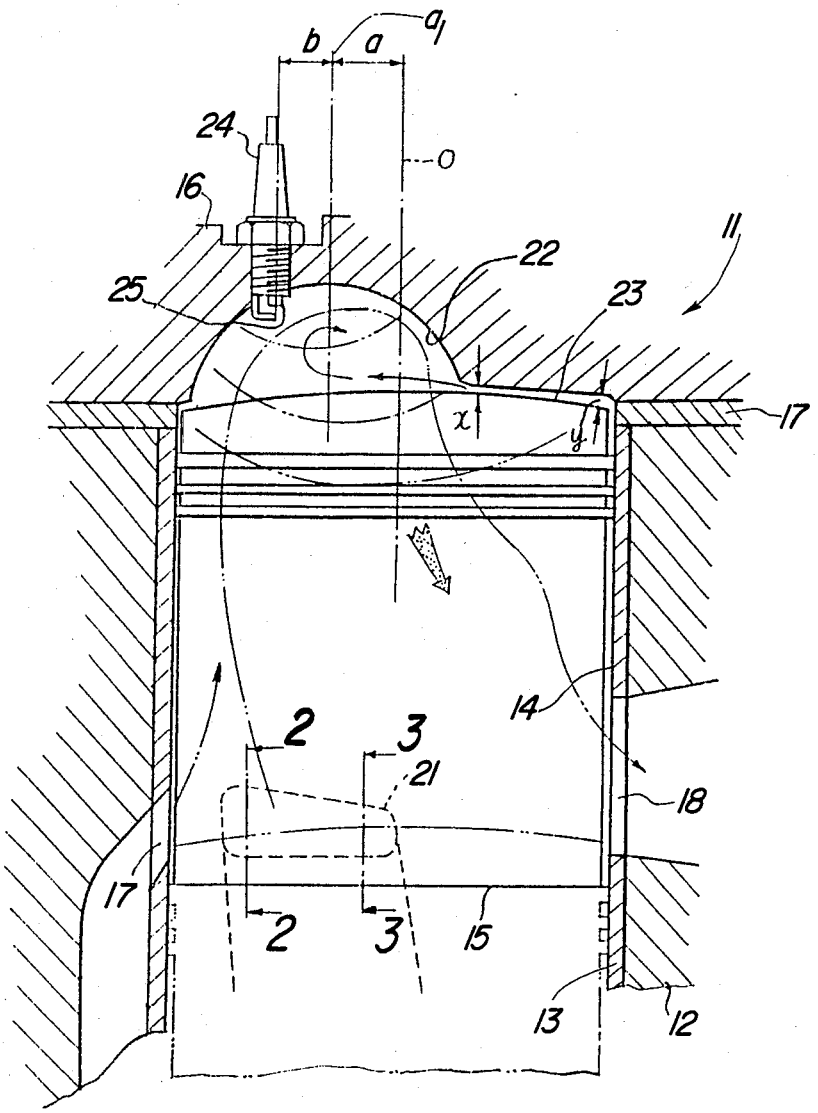
FIG. 1 is a cross-sectional view taken on a vertical plane through the cylinder bore axis of a single cylinder of an engine constructed in accordance with the embodiment of the invention.

Referring now to the drawings and primarily to FIG. 1, an internal combustion engine constructed in accordance with an embodiment of the invention is identified generally by the reference numeral 11. The engine 11 includes a cylinder block 12 in which one or more cylinder liners 13 are provided so as to provide cylinder bores 14. Pistons 15 are reciprocally supported within the cylinder bores 14 and are connected by means of connecting rods (not shown) to an associated crankshaft for driving the crankshaft in a known manner.

A cylinder head 16 is affixed to the cylinder block 12 in a known manner with a cylinder head gasket 17 being interposed between the cylinder head 16 and the cylinder block 12 for sealing purposes.

An exhaust port 18 is formed in the cylinder block 12 and cylinder liner 13 at one side of the cylinder bore 14. The exhaust port 18, as may be best seen in FIG. 4, has a generally rectangular configuration in a developed view. The exhaust port 18 communicates with a suitable exhaust system for discharging the burnt combustion products from the combustion chamber, to be described, to the atmosphere.

A series of intake or scavenge ports are formed on the diametrically opposite side of the cylinder bore 14 from the exaust port 18. These ports include a main or primary intake or scavenge port 19 which, in the illustrated embodiments, has a generally rectangular shape in plan and a pair of supplemental intake or scavenge ports 21 that are disposed on opposite sides of the main intake port 19 in which extend around the circumference of the cylinder bore 14 from the main intake port 19 toward the exhaust port 18. In the illustrated embodiments, the auxiliary intake ports 21 terminate approximately on a plane containing the cylinder bore axis and extending perpendicularly to the center of the exhaust port 18 and the intake port 19. Such a plane would be perpendicular to the plane of FIG. 1 and contain the cylinder bore axis. The cylinder bore axis is indicated by the line 0 in FIG. 1.

The combustion chamber, which is the clearance volume formed when the piston 15 is at its top dead center position, is comprised of a first large recessed area 22 that is formed in the cylinder head 16 by means of a generally hemispherical recess. The center axis of the recess 21 is indicated by the line $a_1$ in FIG. 1 and is offset from the cylinder bore axis 0 to the opposite the exhaust port 18 and adjacent the main intake port 19.

The main recess 22 is surrounded by a squash area 23 that is defined by facing surfaces of the head of the piston 15 and the undersurface of the cylinder head 16. It should be noted that the squish area has a height x around the main recess 23 and this height may gradually decrease to the height y at the periphery of the piston 15. The configuration may be that disclosed in co-pending application in Ser. No. 936,377.

A spark plug 24 is supported within the cylinder head 16 with its spark gap 25 offset a distance b from the axis $a_1$ of the recess 22 and toward the main intake port 19. It should be noted that the axis $a_1$ is offset from the cylinder bore axis 0 by a distance a. This configuration has been found to provide good flame propogation as well as excellent scavenging.

With respect to the scavenging, it has been found that good results can be achieved if the initial fuel/air charge transferred into the combustion chamber through the intake ports 19 and 21 from the crankcase (not shown) occurs immediately opposite to the exaust port 18 and immediately adjacent the side of the recess 22 adjacent the main intake port 19. It should be noted that the fuel/air charge is admitted to the crankcase of the engine in a known manner, and as is well known in this art, is transferred into the combustion chamber during the downward movement of the piston 15 and during its initial upward movement.

It should be noted that the auxiliary intake ports 21 have an upper surface 26 that is inclined from a horizontal plane 27 that is defined by the top edge of the main intake port 19. The surfaces 26 are downwardly inclined in the direction progressing toward the exhaust port 18. As a result, when the piston 15 moves downwardly, the main intake port 19 will be opened first and the auxiliary intake ports 21 will be opened subsequently and in a way so that a portion of these ports adjacent the main intake port 19 will open first while those adjacent the exhaust port 18 will open later. As has been noted, this has been found to give excellent scavenging effects.

FIG. 5 is a plan view of another intake and exhaust port configuration that will give the desired scavenging effect. In this embodiment, the exhaust port 18 and main intake port 19 have the same configuration as the embodiment of FIGS. 1 through 4. There are provided a pair of auxiliary intake ports 41 that are disposed on the opposite sides of the main intake port 19 and which extend toward the exhaust port 18. The auxiliary intake ports 41 have a stepped upper wall consisting of an upper portion 42, which lies on the same plane 43 as the upper edge of the main intake port 19 and a second, lower portion 44. As a result, the downward movement of the piston will cause the main intake port 19 and a part of the auxiliary intake ports defined by the wall 42 to open first. As a result, the initial charge will flow into the combustion chamber diametrically opposite to the center of the exhaust port 18 and on the side to which the spark plug 24 and combustion chamber recess 22 are offset. Upon subsequently downward movement, the remainder of the auxiliary intake port 41 will open so as to provide a good flow area while insuring the desired flow pattern in the combustion chamber.

FIG. 6 shows still another embodiment of porting arrangement which will provide the desired flow relationship. In this embodiment, the main intake port 19 and exhaust port 18 have a configuration as previously described. There are also provided a pair of auxiliary intake ports 51 which lie on the sides of the main intake port 19 and which extend circumferentially around the cylinder bore 14 toward the exhaust port 18. The upper edge of the main intake port 19 lies on a plane 52 that is disposed above a plane 53 upon which the top edge of the auxiliary intake ports 51 lie. The auxiliary ports 51 in this embodiment have a rectangular configuration and as a result, the main intake port 19 will open first and subsequently, the auxiliary intake ports 51 will open so as to achieve the aforedescribed pattern.

It should be readily apparent from the foregoing description that an improved porting arrangement has been disclosed that will provide extremely good scavenging and ensure complete combustion within the combustion chamber. Although several embodiments of the invention have been illustrated and described, various changes and modifications may be made without departing from the spirit and scope of the invention, as defined by the appended claims.

I claim:

1. In a combustion chamber for a two-cycle crankcase compression internal combustion engine having a cylinder, a cylindrical piston reciprocating in said cylinder, a cylinder head closing said cylinder and defining with said piston and said cylinder a combustion chamber, said combustion chamber being comprised of a large recessed area at one side of said cylinder and a surrounding squish area when said piston is at its top dead center, exhaust port means opening into said cylinder at a side thereof opposite said one side for receiving and discharging exhaust gases from said combustion chamber, and transfer port meand disposed on said one side of said cylinder and extending circumferentially therearound to a position contiguous to said exhaust port means for admitting a charge to said cylinder the improvement comprising said transfer port means being configured relative to said piston to introduce the charge into the cylinder initially at the area directly on said one side and upon subsequent motion of the piston progressively circumferentially around said cylinder toward said opposite side.

2. In a combustion chamber for a two-cycle crankcase compression internal combustion engine as set forth in claim 1 further including means for initiating combustion disposed within the recessed area and offset from the center thereof toward the one side of the cylinder.

3. In a combustion chamber for a two-cycle crankcase compression internal combustion engine as set forth in claim 2 wherein the means for initiating combustion comprises a spark plug.

4. In a combustion chamber for a two-cycle crankcase compression internal combustion engine as set forth in claim 1 wherein the recessed area comprises a surface of revolution generated about an axis offset from the cylinder bore axis toward the one side.

5. In a combustion chamber for a two-cycle crankcase compression internal combustion engine as set forth in claim 4 further including means for initiating combustion disposed within the recessed area and offset from the center thereof toward the one side of the cylinder.

6. In a combustion chamber for a two-cycle crankcase compression internal combustion engine as set forth in claim 5 wherein the means for initiating combustion comprises a spark plug.

7. In a combustion chamber for a two-cycle crankcase compression internal combustion engine as set forth in claim 1 wherein the transfer port means comprises a main transfer port and a pair of auxiliary transfer ports disposed on opposite sides of said main transfer port and extending toward the exhaust port means.

8. In a combustion chamber for a two-cycle crankcase compression internal combustion engine as set forth in claim 7 wherein the main transfer port is configured so that it opens fully before the auxiliary transfer ports are fully opened.

9. In a combustion chamber for a two-cycle crankcase compression internal combustion engine as set forth in claim 8 wherein the auxiliary transfer ports initially open at the same time the main transfer port opens but have a lesser effective area on the initial opening.

10. In a combustion chamber for a two-cycle crankcase compression internal combustion engine as set forth in claim 9 wherein the auxiliary transfer ports open at a progressively increasing rate.

11. In a combustion chamber for a two-cycle crankcase compression internal combustion engine as set forth in claim 9 wherein the auxiliary intake ports open in a stepped fashion.

12. In a combustion chamber for a two-cycle crankcase compression internal combustion engine as set forth in claim 8 wherein the auxiliary intake ports open after the main intake port opens.

* * * * *